US007186091B2

(12) United States Patent
Lee et al.

(10) Patent No.: US 7,186,091 B2
(45) Date of Patent: Mar. 6, 2007

(54) METHODS AND APPARATUS FOR COOLING GAS TURBINE ENGINE COMPONENTS

(75) Inventors: Ching-Pang Lee, Cincinnati, OH (US); Ronald Scott Bunker, Niskayuna, NY (US); Harvey Michael Maclin, Cincinnati, OH (US); Ramgopal Darolia, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/984,292

(22) Filed: Nov. 9, 2004

(65) Prior Publication Data

US 2006/0099080 A1 May 11, 2006

(51) Int. Cl.
*F01D 5/18* (2006.01)

(52) U.S. Cl. ..... 416/231 R; 416/241 B; 60/753; 60/754

(58) Field of Classification Search ..... 416/241 B, 416/231 R; 60/753, 754
See application file for complete search history.

(56) References Cited

U.S. PATENT DOCUMENTS 5,271,967 A 12/1993 Kramer et al.
5,494,704 A 2/1996 Ackerman
5,503,874 A 4/1996 Ackerman et al.
5,780,110 A 7/1998 Schaeffer et al.
5,941,686 A * 8/1999 Gupta et al. ..... 416/241 R
6,039,537 A 3/2000 Scheurlen
6,210,488 B1 4/2001 Bruce
6,238,743 B1 5/2001 Brooks
6,241,469 B1 6/2001 Beeck et al.
6,375,425 B1 4/2002 Lee et al.
6,408,610 B1 6/2002 Caldwell et al.
6,478,535 B1 11/2002 Chung et al.
6,511,762 B1 * 1/2003 Lee et al. ..... 416/241 B
6,761,956 B1 7/2004 Lee et al.
2003/0021905 A1 1/2003 Lee et al.
2003/0115881 A1 * 6/2003 Lee et al. ..... 60/754

FOREIGN PATENT DOCUMENTS

EP 0807744 A2 11/1997
EP 1318273 A2 5/2002

(Continued)

OTHER PUBLICATIONS

International Search Report; Place of Search MUNICH; Dated Feb. 22, 2006; Reference 124619/11067; Application No. 05256817.7-2315; 8 Pgs.

*Primary Examiner*—Richard A. Edgar
(74) *Attorney, Agent, or Firm*—William Scott Andes; Armstrong Teasdale LLP

(57) ABSTRACT

A method of cooling a gas turbine engine component having a perforate metal wall includes providing a plurality of pores in the wall, wherein the pores extend substantially perpendicularly through the wall, and wherein the pores are covered and sealed closed at first ends thereof by a thermal barrier coating disposed over a first surface of the wall, and providing a plurality of film cooling holes in the wall, wherein the holes extend substantially perpendicularly through the wall and the thermal barrier coating. The method also includes providing cooling fluid to the plurality of pores and the plurality of film cooling holes along a second surface of the wall, channeling the cooling fluid through the pores for back side cooling an inner surface of the thermal barrier coating, and channeling the cooling fluid through the holes for film cooling an outer surface of the thermal barrier coating.

18 Claims, 4 Drawing Sheets

FOREIGN PATENT DOCUMENTS

EP 1321629 A2 6/2003

EP 1340587 A2 9/2003

* cited by examiner

METHODS AND APPARATUS FOR COOLING GAS TURBINE ENGINE COMPONENTS

BACKGROUND OF THE INVENTION

This invention relates generally to gas turbine engines, and more particularly, to methods and apparatus for cooling gas turbine engine components.

Within known gas turbine engines, combustor and turbine components are directly exposed to hot combustion gases. As such, the components are cooled during operation by pressurized air channeled from the compressor. However, diverting air from the combustion process may decrease the overall efficiency of the engine.

To facilitate cooling engine components while minimizing the adverse effects to engine efficiency, at least some engine components include dedicated cooling channels coupled in flow communication with cooling lines. In at least some known engines, the cooling channels may include cooling holes through which the cooling air is re-introduced into the combustion gas flowpath. Film cooling holes are common in engine components and provide film cooling to an external surface of the components and facilitate internal convection cooling of the walls of the component. To facilitate protecting the components from the hot combustion gases, the exposed surfaces of the engine components may be coated with a bond coat and a thermal barrier coating (TBC) which provides thermal insulation.

The durability of known TBC may be affected by the operational temperature of the underlying component to which it is applied. Specifically, as the bond coating is exposed to elevated temperatures, it may degrade, and degradation of the bond coating may weaken the TBC/bond coating interface and shorten the useful life of the component. However, the ability to cool both the bond coating and/or the TBC is limited by the cooling configurations used with the component.

BRIEF DESCRIPTION OF THE INVENTION

In one aspect, a method of cooling a gas turbine engine component having a perforate metal wall is provided. The method includes forming a plurality of pores in a wall of the component, wherein the pores extend substantially perpendicularly through the wall, and forming a plurality of film cooling holes in the wall, wherein the holes extend substantially perpendicularly through the wall. The method also includes coating the wall of the component with a thermal barrier coating (TBC) such that the TBC extends over and seals a first end of the pores, and coupling the component in flow communication to a cooling fluid source, such that during operation cooling fluid may be channeled through the pores for back side cooling an inner surface of the thermal barrier coating, and such that cooling fluid may be channeled through the holes for film cooling an outer surface of the thermal barrier coating.

In another aspect, a gas turbine engine component is provided including a substrate wall having a first surface and an opposite second surface. The component also includes a plurality of pores extending through the wall, a thermal barrier coating (TBC) extending over the wall first surface, wherein the TBC substantially seals the pores at the first surface, and a plurality of film cooling holes extending through the wall and the TBC. The plurality of film cooling holes and the plurality of pores extend substantially perpendicularly through the wall and the TBC.

In a further aspect, a gas turbine engine component is provided including a substrate wall having a first surface and on opposite second surface. The component also includes a plurality of pores having a frusto-conical shape between first ends and second ends of the plurality of pores, a thermal barrier coating (TBC) extending over the wall first surface, wherein the TBC substantially seals the first ends of the plurality of pores, and a plurality of film cooling holes having a frusto-conical shape between first ends and second ends of the plurality of holes, wherein the holes extend through the wall and the TBC.

DETAILED DESCRIPTION OF THE INVENTION

Figure 1:
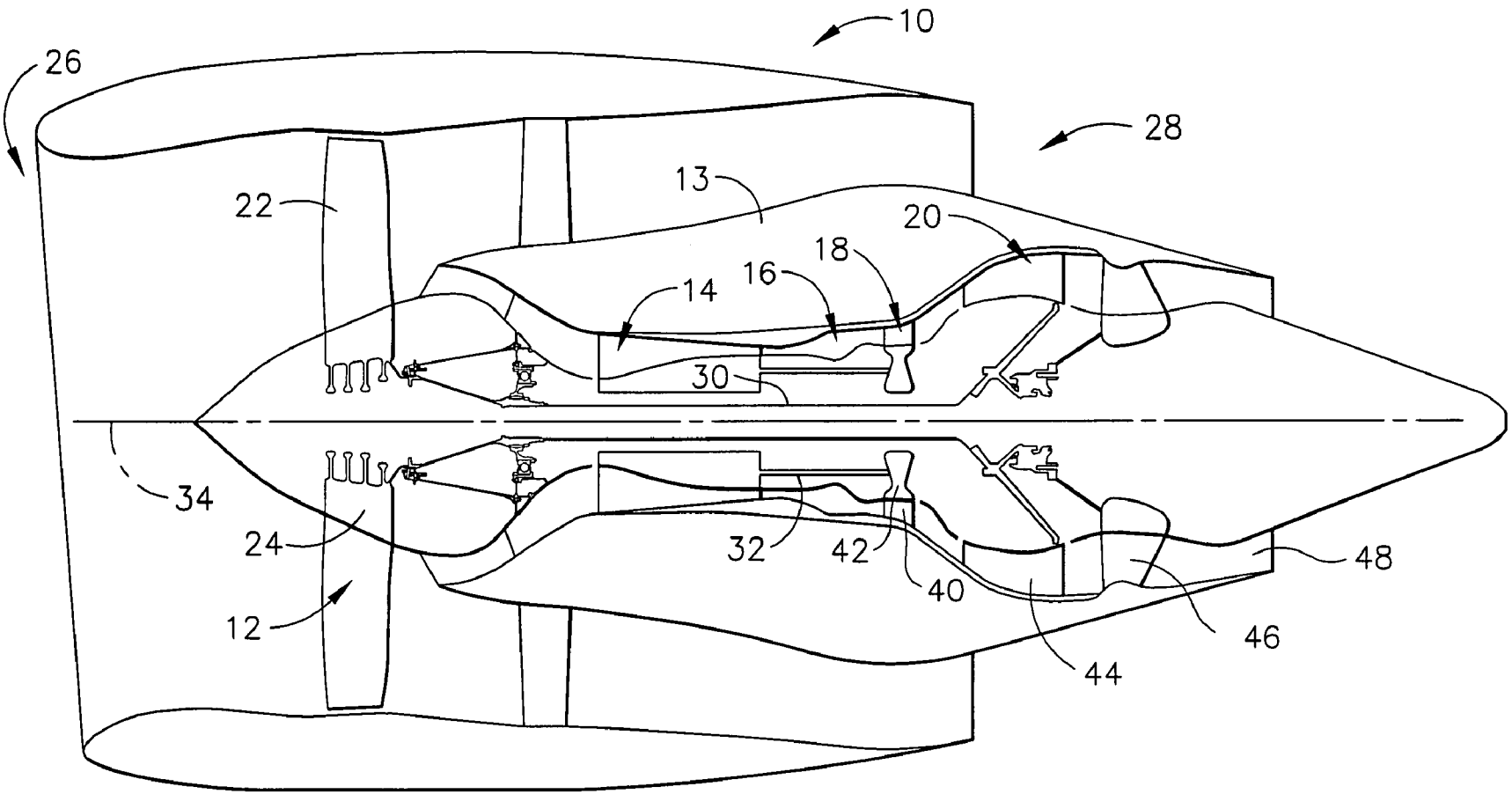
FIG. 1 is a schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18 and a low pressure turbine 20. Fan assembly 12 includes an array of fan blades 22 extending radially outward from a rotor disc 24. Engine 10 has an intake side 26 and an exhaust side 28. Fan assembly 12 and turbine 20 are coupled by a first rotor shaft 30, and compressor 14 and turbine 18 are coupled by a second rotor shaft 32.

During operation, air flows generally axially through fan assembly 12, in a direction that is substantially parallel to a central axis 34 extending through engine 10, and compressed air is supplied to high pressure compressor 14. The highly compressed air is delivered to combustor 16. Airflow (not shown in FIG. 1) from combustor 16 drives turbines 18 and 20, and turbine 20 drives fan assembly 12 by way of shaft 30. Turbine 18 drives high-pressure compressor 14 by way of shaft 32.

Combustor 16 includes annular outer and inner liners (not shown) which define an annular combustion chamber (not shown) that bounds the combustion process during operation. A portion of pressurized cooling air is diverted from compressor 14 and is channeled around outer and inner liners to facilitate cooling during operation.

High pressure turbine 18 includes a row of turbine rotor blades 40 extending radially outwardly from a supporting rotor disk 42. Turbine rotor blades 40 are hollow and a portion of compressor air is channeled through blades 40 to facilitate cooling during engine operation. An annular turbine shroud (not shown) surrounds the row of high pressure turbine blades 40. The turbine shroud is typically cooled along an outer surface (not shown) through cooling air diverted from compressor 14.

Low pressure turbine 20 includes corresponding rows of rotor blades 44 and stator vanes 46 with corresponding shrouds and/or nozzle bands (not shown) which may also be cooled through cooling air diverted from compressor 14.

Figure 2:
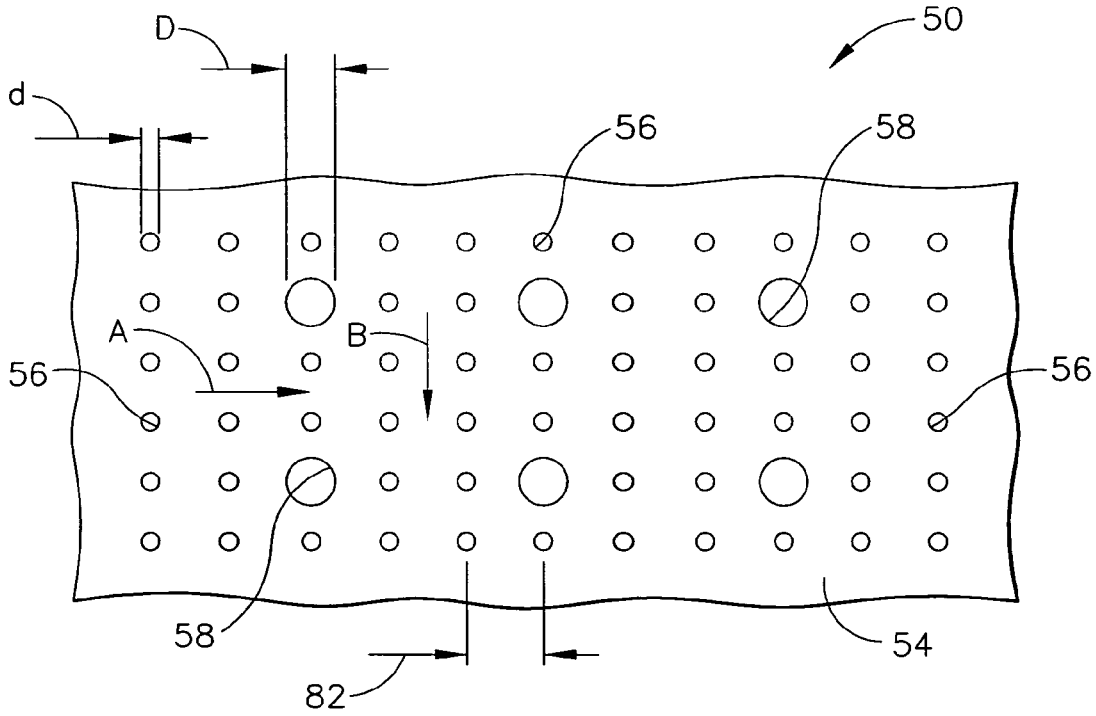
FIG. 2 illustrates a bottom perspective view of an exemplary substrate wall that may be used with the gas turbine engine shown in FIG. 1.
Figure 3:
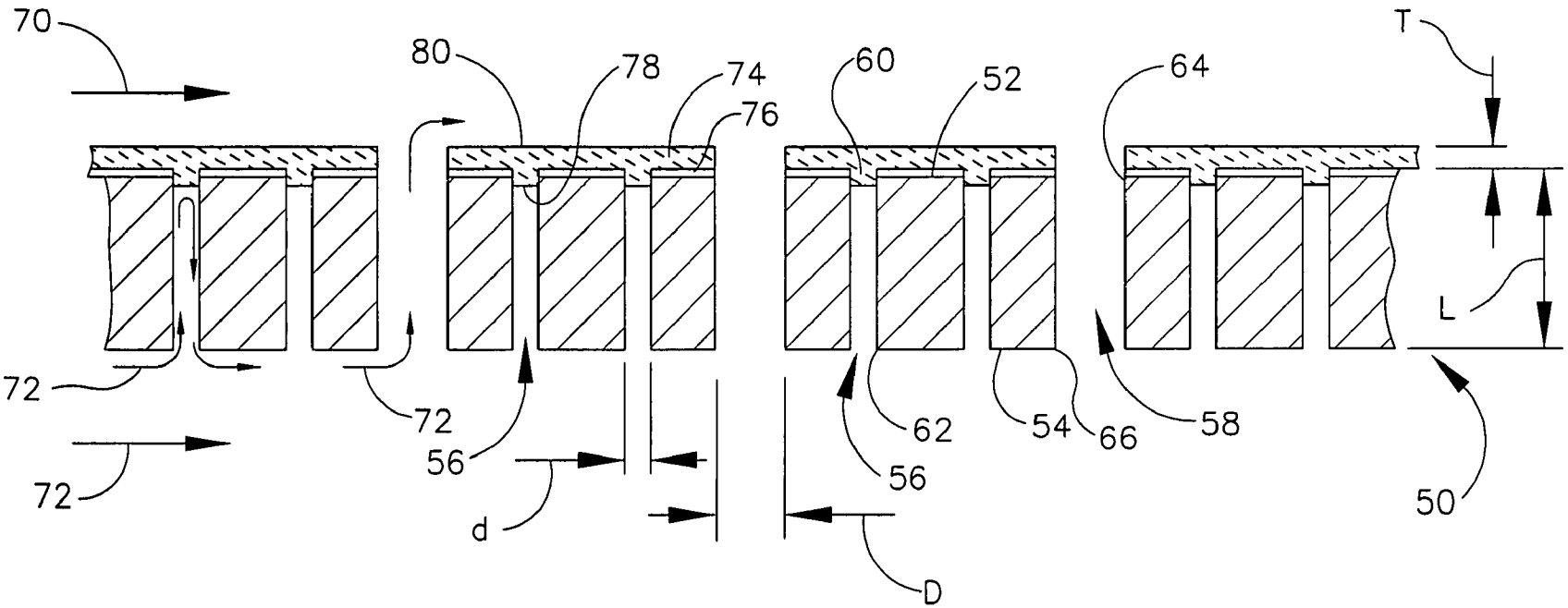
FIG. 3 is a side perspective view of the substrate wall shown in FIG. 2.

FIG. 2 illustrates a bottom perspective view of an exemplary substrate wall 50 that may be used with components within gas turbine engine 10 (shown in FIG. 1), such as, but not limited to, the various engine components described above. For example, substrate wall 50 may be used with, but is not limited to use with, combustor liners, high pressure turbine blades 40, the turbine shroud, low pressure turbine blades 44, and/or low pressure turbine stator vanes 46. FIG. 3 is a side perspective view of substrate wall 50. In the exemplary embodiment, substrate wall 50 is fabricated from a superalloy metal having the ability to withstand high temperatures during operation of engine. For example, substrate wall 50 may be fabricated from, but is not limited to, materials such as nickel or cobalt based superalloys.

Wall 50 includes an exposed outer surface 52 and an opposite inner surface 54. In the exemplary embodiment, wall 50 is perforate or porous and includes a plurality of pores 56 that are distributed across in a spaced relationship across wall 50. Additionally, wall 50 includes a multitude of film cooling holes 58 that are distributed across wall 50 amongst pores 56. Pores 56 and holes 58 extend between outer and inner surfaces 52 and 54, respectively. In the exemplary embodiment, each pore 56 includes an exhaust side and an opposite inlet side 60 and 62, respectively. Holes 58 also each include corresponding exhaust and inlet sides 64 and 66, respectively. In the exemplary embodiment, pores 56 and holes 58 extend substantially perpendicularly through wall 50 with respect to surface 52. In an alternative embodiment, pores 56 and/or holes 58 are obliquely oriented with respect to surface 52.

In the exemplary embodiment, film cooling holes 58 are substantially cylindrical and have a diameter D, and pores 56 are substantially cylindrical and have a diameter d that is smaller than hole diameter D. In one embodiment, pore diameter d is approximately equal and between three and five mils (0.0762 and 0.127 mm), and hole diameter D is approximately equal and between eight and fifteen mils (0.2032 and 0.381 mm). In another embodiment, pore diameter d is approximately equal and between five and eight mils (0.125 and 0.2032 mm), and hole diameter D is approximately equal and between fifteen and forty mils (0.381 and 1.016 mm). In yet another embodiment, hole diameter D is approximately equal and between forty and sixty mils (1.016 and 1.524 mm). Pore diameter d and hole diameter D are variably selected based on the particular application and surface area of the component being cooled. Pores 56 and holes 58 are spaced along wall 50 in a grid-like pattern wherein a film cooling hole 58 replaces every N-th pore 56. In the exemplary embodiment, holes 58 replace every third pore 56. In the exemplary embodiment, pores 56 and holes 58 are spaced along wall outer surface 52 in a substantially uniform grid pattern wherein a plurality of substantially parallel rows of pores 56, or rows of pores 56 and holes 58, extend along wall 50 in a first direction, shown by arrow A. Additionally, a plurality of substantially parallel rows of pores 56, or rows of pores 56 and holes 58, extend along wall 50 in a second direction, shown by arrow B, that is substantially perpendicular to the first direction.

During operation, combustion gases 70 flow past outer surface 52, and cooling air 72 is channeled across inner surface 54. In the exemplary embodiment, wall outer surface 52 is covered by a known thermal barrier coating (TBC) 74, in whole or in part, as desired. TBC 74 facilitates protecting outer surface 52 from combustion gases 70. In the exemplary embodiment, a metallic bond coating 76 is laminated between wall outer surface 52 and TBC 74 to facilitate enhancing the bonding of TBC 74 to wall 50.

In the exemplary embodiment, TBC 74 covers wall outer surface 52 and also extends over pore exhaust side 60. More specifically, a substantially smooth and continuous layer of TBC 74 extends over wall outer surface 52 and is anchored thereto by corresponding plugs, or ligaments 78, formed in pore exhaust side 60. However, because hole diameter D is greater than a thickness T of TBC 74, TBC 74 does not extend over hole exhaust sides 64. As such, cooling fluid may be channeled through holes 58 and through TBC 74 layer to facilitate cooling an outer surface 80 of TBC 74. In one embodiment, TBC 74 may extend over a portion of hole exhaust sides 64.

Pores 56 facilitate enhancing the thermal performance and durability of component wall 50, including, in particular, TBC 74. The pattern of pores 56 is selected to facilitate reducing an average operating temperature of wall 50, bond coating 76, and/or TBC 78 by reducing hot spots within the TBC-substrate interface. Accordingly, pores 56 facilitate increasing the useful life of TBC 74 through ventilation cooling. Film cooling holes 58 are sized and oriented to facilitate providing a desired film cooling layer over TBC outer surface 74, and pores 56 are sized and distributed to facilitate providing effective back-side cooling of TBC 74 and/or bond coating 76. In one embodiment, adjacent pores 56 are spaced apart from each other and/or from holes 58 by a distance 82 of between approximately 15 and 40 mils (0.381 and 1.016 mm). Distance 82 is variably selected to facilitate cooling wall 50 and/or TBC 74. Moreover, pore inlet sides 62 provide local interruptions in the continuity of wall inner surface 54 which generate turbulence as cooling air 72 flows thereover during operation. The turbulence facilitates enhanced cooling of wall 50.

In the exemplary embodiment, pores 56 and film cooling holes 58 are formed using any suitable process such as, but not limited to, an electron beam (EB) drilling process. Alternatively, other machining processes may be utilized, such as, but not limited to, electron discharge machining (EDM) or laser machining. Bond coating 76 is then applied to cover wall outer surface 52. In the exemplary embodiment, bond coating 76 is also applied as a lining for pores 56 and/or holes 58. As such, bond coating 76 extends inside holes 58 between opposite sides 64 and 66 thereof, and/or extends inside pores 56 between opposite sides 60 and 62 thereof. In the exemplary embodiment, pore diameter d is approximately five mils (0.127 mm), and bond coating 76 is applied with a thickness of approximately one to two mils (0.0254 to 0.0508 mm) to facilitate preventing plugging of pores 56 with bond coating 76.

In the exemplary embodiment, TBC 74 is applied to extend at least partially inside pores 56 such that TBC 74 extends substantially continuously over wall outer surface 52, and such that exhaust sides 60 are effectively filled. However, because hole diameter D is wider than the TBC thickness T, holes 58 remain open through TBC 74. As such, cooling air 72 channeled over wall inner surface 54 is in flow communication with corresponding hole inlet sides 66, and is channeled through wall 50 and TBC 74 to facilitate film cooling TBC outer surface 80. However, because pores 56 are partially filled by TBC plugs 78, cooling air 72 channeled over wall inner surface 54 and into pore inlet sides 62 is prevented from flowing beyond pore exhaust side 60 by TBC plugs 78. Thus, unintended leakage of the cooling air through wall 50 is prevented. Accordingly, TBC 74 extends substantially over wall 50 and provides a generally aerodynamically smooth surface preventing undesirable leakage of cooling air 72 through pores 56.

In the exemplary embodiment, TBC 74 extends into approximately the top 10% to 20% of the full height or length L of pores 56, such that the bottom 80% to 90% of pores 56 remains unobstructed and open. Accordingly, cooling air 72 may enter pores 56 to facilitate providing internal convection cooling of wall 50 and, providing cooling to the back side of TBC 74 and to bond coating 76. Accordingly, the operating temperature of bond coating 76 is reduced, thus increasing the useful life of TBC 74.

In the exemplary embodiment, because pores 56 extend substantially perpendicularly through wall 50, pore length L, and thus the heat transfer path through wall 50, is decreased. Accordingly, during operation, wall 50 is facilitated to be cooled by cooling air 72 filling pores from the back side thereof.

In the exemplary embodiment, pores 56 facilitate protecting wall 50, bond coating 76 and/or TBC 74 if cracking or spalling in the TBC occurs during operation. Specifically, if a TBC crack extends into one or more pores 56, cooling air 72 flows through the crack to provide additional local cooling of TBC 74 adjacent the crack such that additional degradation of the crack is facilitated to be prevented. Additionally, if spalling occurs, pores 56 provide additional local cooling of wall outer surface 52. Since the pores are relatively small in size, any airflow leakage through such cracks or spalled section is negligible and will not adversely affect operation of the engine.

Figure 4:
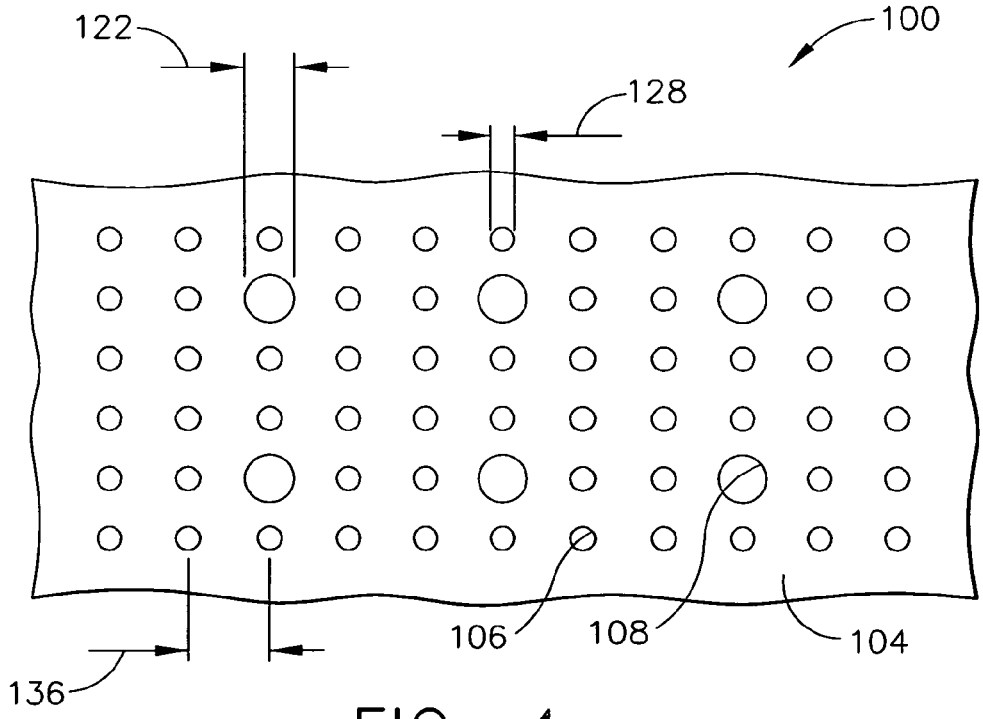
FIG. 4 illustrates a bottom perspective view of an alternative substrate wall that may be used with the gas turbine engine shown in FIG. 1.
Figure 5:
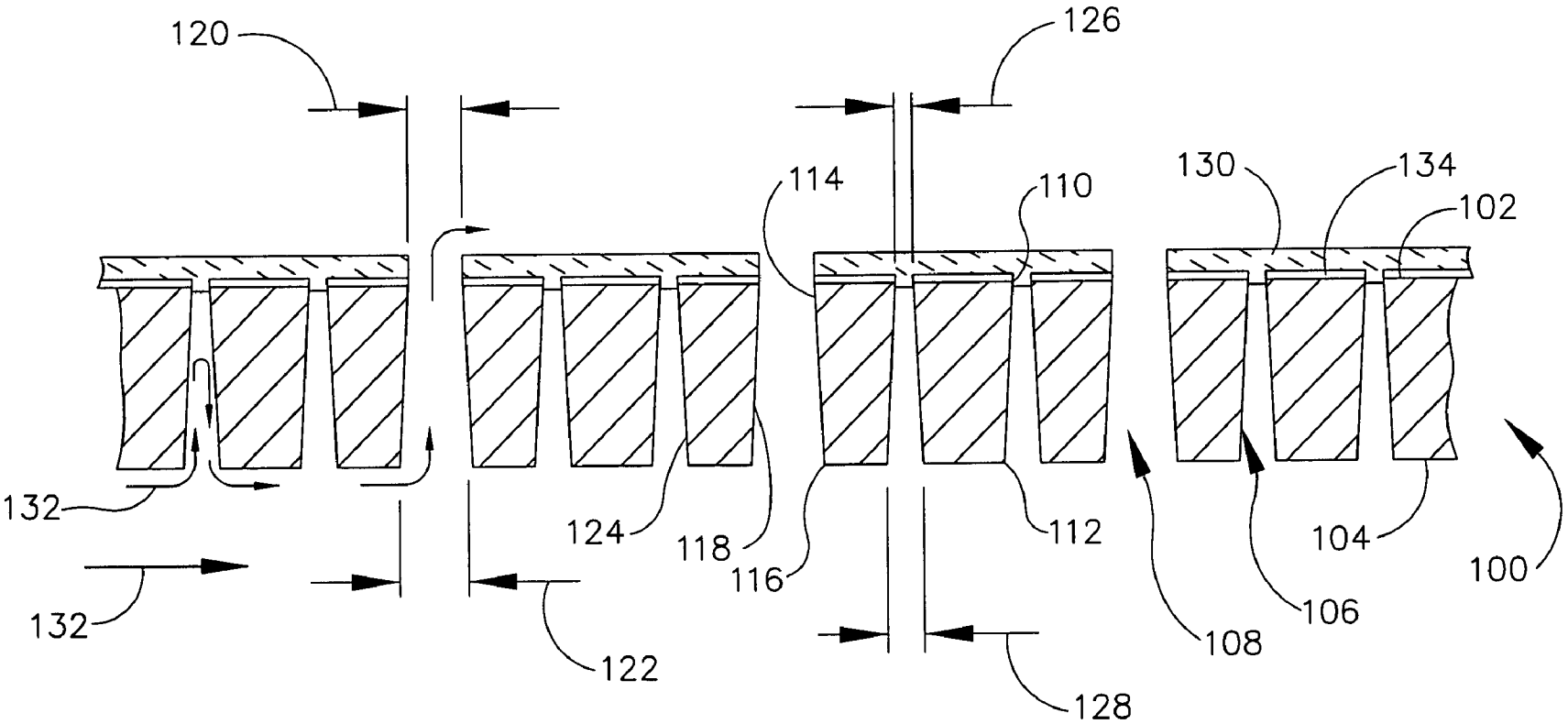
FIG. 5 is a side perspective view the substrate wall shown in FIG. 4.

FIG. 4 illustrates a bottom perspective view of an exemplary substrate wall 100 that may be used with gas turbine engine 10 (shown in FIG. 1). FIG. 5 is a side perspective view of substrate wall 100. Wall 100 includes an outer surface 102 and an opposite inner surface 104. In the exemplary embodiment, wall 100 is perforate or porous and includes a plurality of pores 106 distributed across wall 100 in a spaced relationship. Additionally, wall 100 includes film cooling holes 108 that are dispersed across wall amongst pores 106. Pores 106 and holes 108 extend between outer and inner surfaces 102 and 104, respectively. In the exemplary embodiment, each pore 106 includes an exhaust side 110 and an opposite inlet side 112. Holes 108 also each include exhaust and inlet sides 114 and 116, respectively. In the exemplary embodiment, pores 106 and holes 108 extend perpendicularly through wall 100.

In the exemplary embodiment, film cooling holes 108 have a frusto-conical shape. Specifically, each hole 108 includes a sloped side wall 118 that extends from exhaust side 114 to inlet side 116. In the exemplary embodiment, hole exhaust side 114 has a first diameter 120 and hole inlet side 116 has a second diameter 122 that is different than hole exhaust side 114. Specifically, in the exemplary embodiment, first diameter 120 is smaller than second diameter 122. Because of the increases diameter of hole inlet side 116, during operation an increased amount of cooling air 132 is channeled into holes 108.

In the exemplary embodiment, pores 106 have a frusto-conical shape. Specifically, each pore 106 includes a sloped side wall 124 extending from exhaust side 110 to inlet side 112. In the exemplary embodiment, pore exhaust side 110 has a first diameter 126 and pore inlet side 112 has a second diameter 128 that is different than pore exhaust side 110. Specifically, in the exemplary embodiment, first diameter 126 is smaller than second diameter 128. Accordingly, first diameter 126 is sized small enough to facilitate being plugged by a thermal barrier coating (TBC) 130, in a similar manner as pore 56 (FIGS. 2 and 3), and as described in detail more above. However, because pore second diameter 128 is larger than pore first diameter 126, during operation an increased amount of cooling air 132 is channeled into pores 106 for back side cooling TBC 130.

In the exemplary embodiment, hole first diameter 120 is between approximately eight and fifteen mils (0.2032 and 0.381 mm), and pore first diameter 126 is between approximately three and five mils (0.0762 and 0.127 mm). Additionally, in the exemplary embodiment, hole second diameter 122 is between approximately ten and twenty mils (0.254 and 0.508 mm), and pore second diameter 128 is between approximately four and six mils (0.1016 and 0.1524 mm). In an alternative embodiment, hole first diameter 120 is between approximately fifteen and forty mils (0.381 and 1.016 mm), and pore first diameter 126 is between approximately five and eight mils (0.127 and 0.2032 mm). Additionally, hole second diameter 122 is between approximately twenty and sixty mils (0.508 and 1.524 mm), and pore second diameter 128 is between approximately six and ten mils (0.1524 and 0.254 mm). In the exemplary embodiment, pores 106 and holes 108 are spaced along wall 100 in a substantially uniform grid-like pattern. Alternatively, holes 108 are dispersed along wall 100 amongst pores 106 in a non-uniform manner. Hole diameters 120 and 122, and pore diameters 126 and 128 are variably selected to facilitate providing sufficient cooling air 132 through holes 108 and pores 106, while maintaining the structural integrity of wall 100. In one embodiment, adjacent pores 106 are spaced a distance 136 apart from one another and/or from holes 108. In the exemplary embodiment, distance 136 is between approximately 15 and 40 mils (0.381 and 1.016 mm). Distance 136 is variably selected to facilitate cooling wall 100 and/or TBC 130.

In the exemplary embodiment, a bond coating 134 is applied between wall outer surface 102 and TBC 130 to facilitate enhancing bonding of TBC 130 to wall 100.

Pores 56 and 106 provide cooling air to facilitate backside ventilation and cooling of bond coating 76 or 134 and/or TBC 74 or 130. Moreover, pores 56 and 106 facilitate reducing the overall weight of the component. However, because the fabrication of pores 56 or 106 may increase the manufacturing costs of wall 50, TBC 74 or 130 is only selectively applied to those components requiring an enhanced durability and life of TBC 74 or 130, and is generally only applied to areas of individual components that are subject to locally high heat loads. For example, in one embodiment, TBC 74 or 130 is applied only to the platform region of turbine blades 40 (shown in FIG. 1). In an alternative embodiment, TBC 74 or 130 is applied only to the leading and trailing edges (not shown), and/or to the tip regions (not shown) of turbine blades 40. The actual location and configuration of TBC 74 or 130 is determined by the cooling and operating requirements of the particular component of gas turbine engine 10 (shown in FIG. 1) requiring protection from combustion gases 70.

The exemplary embodiments described herein illustrate methods and apparatus for cooling components in a gas turbine engine. Because the wall of the component includes a plurality of pores and film cooling holes, the component may be cooled by both a ventilation process and a transpiration process. Utilizing the film cooling holes facilitates cooling an outer surface of the component wall and any TBC extending across the wall outer surface. Moreover, utilizing the pores facilitates cooling an interior of the component wall and the backside of the TBC. Moreover, the pores and holes facilitate reducing the overall weight of the component wall.

Exemplary embodiments of a substrate wall having a plurality of ventilation pores and film cooling holes are described above in detail. The components are not limited to the specific embodiments described herein, but rather, components of each wall may be utilized independently and separately from other components described herein. For example, the use of a substrate wall may be used in combination with other known gas turbine engines, and other known gas turbine engine components.

While the invention has been described in terms of various specific embodiments, those skilled in the art will recognize that the invention can be practiced with modification within the spirit and scope of the claims.

What is claimed is:

1. A method of fabricating a gas turbine engine component, said method comprising forming a plurality of pores in a wall of the component, wherein the pores extend substantially perpendicularly through the wall, wherein the wall includes a first surface and an opposite second surface, wherein the pores each include a first diameter defined by the wall first surface and a second diameter defined by the opposite wall second surface;

forming a plurality of film cooling holes in the wall, wherein the holes extend substantially perpendicularly through the wall;

coating the first wall surface of the wall of the component with a thermal barrier coating (TBC) such that the TBC extends over and seals a first end of the pores, wherein at least one of the plurality of pores has the first diameter at the first wall surface that is smaller than the second diameter at the opposite wall second surface therein; and coupling the component in flow communication to a cooling fluid source, such that during operation cooling fluid may be channeled through the pores for back side cooling an inner surface of the thermal barrier coating, and such that cooling fluid may be channeled through the holes for film cooling an outer surface of the thermal barrier coating.

2. A method in accordance with claim 1 wherein forming a plurality of pores comprises forming a plurality of pores each having a frusto-conical shape such that the pores each have the first diameter at the wall first surface that is smaller than the second diameter at the opposite wall second surface.

3. A method in accordance with claim 1 wherein forming a plurality of holes comprises forming a plurality of holes each having a frusto-conical shape such that the holes each have a first diameter defined by the wall first surface that is smaller than second diameter defined by the opposite wall second surface therein.

4. A gas turbine engine component comprising:

a substrate wall comprising a first surface and an opposite second surface;

a plurality of pores extending through said wall, wherein said plurality of pores each include a first diameter defined by said wall first surface and a second diameter defined by said opposite wall second surface;

a thermal barrier coating (TBC) extending over said wall first surface, said TBC substantially sealing said pores at said first surface; and a plurality of film cooling holes extending through said wall and said TBC, said plurality of film cooling holes and said plurality of pores extending substantially perpendicularly through said wall and said TBC, wherein at least one of said plurality of pores has said first diameter at said wall first surface that is smaller than said second diameter at said opposite wall second surface therein.

5. A component in accordance with claim 4 wherein said plurality of pores facilitate reducing an operating temperature of said wall and said TBC.

6. A component in accordance with claim 4 wherein said plurality of pores and said plurality of holes are open along said wall second surface.

7. A component in accordance with claim 4 wherein each of said plurality of pores includes a centerline axis extending therethrough, each of said plurality of holes includes a centerline axis extending therethrough, each said pore centerline axis is substantially parallel to each said hole centerline axis.

8. A component in accordance with claim 4 wherein said plurality of pores and said plurality of holes are spaced across said wall in a substantially uniform grid pattern such that a plurality of parallel rows of pores and holes extend along said wall in a first direction and a plurality of parallel rows of pores and holes extend along the wall in a second direction that is substantially perpendicular to the first direction.

9. A component in accordance with claim 8 wherein said holes replace every N-th pore within each of said parallel rows extending along the wall in the first direction, said holes replace every N-th pore within said parallel rows extending along said wall in the second direction.

10. A component in accordance with claim 4 wherein each of said plurality of pores has a diameter between about 3 mils and 6 mils, and said holes have a diameter between about 8 mils and 20 mils.

11. A gas turbine engine component comprising:

a substrate wall comprising a first surface and on opposite second surface;

a plurality of pores having a frusto-conical shape between first ends having a first diameter defined by said wall first surface and second ends having a second diameter defined by said opposite wall second surface;

a thermal barrier coating (TBC) extending over said wall first surface, said TBC substantially sealing said first ends of said plurality of pores; and a plurality of film cooling holes having a frusto-conical shape between first ends and second ends of said plurality of holes, said holes extending through said wall and said TBC, wherein at least one of said plurality of pores has said first diameter of said first end that is smaller than said second diameter of said second end therein.

12. A component in accordance with claim 11 said plurality of pores facilitate reducing an operating temperature of said wall and said TBC.

13. A component in accordance with claim 11 wherein each of said hole first ends has a third diameter, and each of said hole second ends has a fourth diameter that is different than said third diameter.

14. A component in accordance with claim 13 wherein said first diameter is smaller than said second diameter and said third diameter, and said second and third diameters are smaller than said diameter.

15. A component in accordance with claim 13 wherein said first diameter is smaller than said second diameter and said third diameter, said third diameter is smaller than said fourth diameter, and said second diameter is substantially equal to said fourth diameter.

16. A component in accordance with claim 13 wherein said first diameter is between about 3 mils and 4 mils, said second diameter is between about 4 mils and 6 mils, said third diameter is between about 8 mils and 10 mils, and said fourth diameter is between about 10 mils and 15 mils.

17. A component in accordance with claim 11 wherein said plurality of pores and said plurality of holes are spaced across said wall in a substantially uniform grid pattern such that a plurality of parallel rows of pores and holes extend along said wall in a first direction and a plurality of parallel rows of pores and holes extend along the wall in a second direction that is substantially perpendicular to the first direction.

18. A component in accordance with claim 17 wherein said holes replace every N-th pore within each of said parallel rows extending along the wall in the first direction, said holes replace every N-th pore within said parallel rows extending along said wall in the second direction.

* * * * *

UNITED STATES PATENT AND TRADEMARK OFFICE

CERTIFICATE OF CORRECTION

PATENT NO. : 7,186,091 B2
APPLICATION NO. : 10/984292
DATED : March 6, 2007
INVENTOR(S) : Lee et al.

It is certified that error appears in the above-identified patent and that said Letters Patent is hereby corrected as shown below:

In Claim 3, column 7, line 48, after “smaller than” insert -- a --.

Signed and Sealed this

Eighteenth Day of September, 2007

JON W. DUDAS
*Director of the United States Patent and Trademark Office*